US008347636B2

(12) United States Patent
Butkiewicz et al.

(10) Patent No.: US 8,347,636 B2
(45) Date of Patent: Jan. 8, 2013

(54) TURBOMACHINE INCLUDING A CERAMIC MATRIX COMPOSITE (CMC) BRIDGE

(75) Inventors: Jeffrey John Butkiewicz, Greenville, SC (US); Andres Jose Garcia-Crespo, Greenville, SC (US); Stanley Frank Simpson, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/889,860

(22) Filed: Sep. 24, 2010

(65) Prior Publication Data

US 2012/0073304 A1 Mar. 29, 2012

(51) Int. Cl.
*F23R 3/60* (2006.01)

(52) U.S. Cl. ..... 60/800; 60/752

(58) Field of Classification Search ..... 60/752–760, 60/796–800; 415/9, 92, 110, 134, 136–139, 415/191, 197, 199.5, 200, 202
See application file for complete search history.

(56) References Cited

U.S. PATENT DOCUMENTS

| | | | | |
|---|---|---|---|---|
| 5,265,412 | A * | 11/1993 | Bagepalli et al. | 60/800 |
| 5,657,998 | A * | 8/1997 | Dinc et al. | 277/653 |
| 5,687,572 | A * | 11/1997 | Schrantz et al. | 60/753 |
| 5,854,154 | A | 12/1998 | Radford et al. | |
| 6,013,592 | A | 1/2000 | Merrill et al. | |
| 6,039,537 | A | 3/2000 | Scheurlen | |
| 6,060,174 | A | 5/2000 | Sabol et al. | |
| 6,071,556 | A | 6/2000 | Beele | |
| 6,106,959 | A | 8/2000 | Vance et al. | |
| 6,111,599 | A | 8/2000 | Nance et al. | |
| 6,197,424 | B1 | 3/2001 | Morrison et al. | |
| 6,235,370 | B1 | 5/2001 | Merrill et al. | |
| 6,251,520 | B1 | 6/2001 | Blizzard et al. | |
| 6,287,511 | B1 | 9/2001 | Merrill et al. | |
| 6,294,260 | B1 | 9/2001 | Subramanian | |
| 6,296,945 | B1 | 10/2001 | Subramanian | |
| 6,322,897 | B1 | 11/2001 | Borchert et al. | |
| 6,350,713 | B1 | 2/2002 | Petrak | |
| 6,382,920 | B1 | 5/2002 | Dopper | |
| 6,384,365 | B1 | 5/2002 | Seth et al. | |
| 6,387,539 | B1 | 5/2002 | Subramanian | |
| 6,512,379 | B2 | 1/2003 | Harrold et al. | |
| 6,514,046 | B1 | 2/2003 | Morrison et al. | |
| 6,517,959 | B1 | 2/2003 | Beele | |
| 6,528,178 | B1 | 3/2003 | Srinivasan | |
| 6,528,189 | B1 | 3/2003 | Beele | |
| 6,528,190 | B1 | 3/2003 | Campbell et al. | |
| 6,575,817 | B2 | 6/2003 | Czech | |
| 6,602,053 | B2 | 8/2003 | Subramanian et al. | |
| 6,617,013 | B2 | 9/2003 | Morrison et al. | |
| 6,641,907 | B1 | 11/2003 | Merrill et al. | |
| 6,648,597 | B1 | 11/2003 | Widrig et al. | |
| 6,670,046 | B1 | 12/2003 | Xia | |
| 6,676,783 | B1 | 1/2004 | Merrill et al. | |
| 6,677,064 | B1 | 1/2004 | Subramanian | |

(Continued)

FOREIGN PATENT DOCUMENTS

EP 1126221 A1 8/2001

(Continued)

*Primary Examiner* — Phutthiwat Wongwian
(74) *Attorney, Agent, or Firm* — Cantor Colburn LLP

(57) ABSTRACT

A turbomachine includes a turbine section including a turbine inlet. A transition piece includes a transition piece inlet and a transition piece outlet. A ceramic matrix composite (CMC) bridge member links the transition piece outlet and the turbine inlet.

18 Claims, 3 Drawing Sheets

U.S. PATENT DOCUMENTS 6,682,300 B2 1/2004 Bolms
6,703,137 B2 3/2004 Subramanian
6,709,230 B2 3/2004 Morrison et al.
6,719,853 B2 4/2004 Buergel et al.
6,733,907 B2 * 5/2004 Morrison et al. ..... 428/699
6,743,393 B1 6/2004 Petrak
6,746,755 B2 6/2004 Morrison et al.
6,751,962 B1 * 6/2004 Kuwabara et al. ..... 60/800
6,758,653 B2 7/2004 Morrison
6,767,659 B1 7/2004 Campbell
6,821,578 B2 11/2004 Beele
6,827,312 B2 12/2004 Riedell
6,835,465 B2 12/2004 Allen et al.
6,838,157 B2 1/2005 Subramanian
6,846,574 B2 1/2005 Subramanian
6,860,108 B2 * 3/2005 Soechting et al. ..... 60/752
6,878,041 B2 4/2005 Esser et al.
6,884,384 B2 4/2005 Merrill et al.
6,902,360 B2 * 6/2005 Meece et al. ..... 409/132
6,929,852 B2 8/2005 Lane et al.
6,933,060 B2 8/2005 Subramanian et al.
6,939,603 B2 9/2005 Oechsner
6,977,060 B1 12/2005 Merrill et al.
6,984,277 B2 1/2006 Morrison et al.
7,001,679 B2 2/2006 Campbell et al.
7,017,415 B2 3/2006 Harrold et al.
7,057,176 B2 6/2006 Rothenfusser et al.
7,066,717 B2 6/2006 Morrison et al.
7,067,181 B2 6/2006 Burke
7,067,447 B2 6/2006 Campbell
7,080,513 B2 7/2006 Reichert
7,093,359 B2 8/2006 Morrison et al.
7,108,925 B2 9/2006 Campbell
7,123,031 B2 10/2006 Twerdochlib
7,153,096 B2 12/2006 Thompson et al.
7,163,747 B2 1/2007 Cox et al.
7,176,681 B2 2/2007 Zombo
7,179,524 B2 2/2007 Merrill et al.
7,182,580 B2 2/2007 Bostanjoglo et al.
7,182,581 B2 2/2007 Bostanjoglo et al.
7,198,458 B2 4/2007 Thompson
7,198,462 B2 4/2007 Merrill et al.
7,198,860 B2 4/2007 Vance
7,217,088 B2 5/2007 Albrecht et al.
7,229,254 B2 6/2007 Bast et al.
7,230,205 B2 6/2007 Twerdochlib
7,237,389 B2 7/2007 Ryan et al.
7,247,002 B2 7/2007 Albrecht et al.
7,247,003 B2 7/2007 Burke et al.
7,250,222 B2 7/2007 Halberstadt et al.
7,250,776 B2 7/2007 Twerdochlib
7,258,530 B2 8/2007 Morrison et al.
7,270,890 B2 9/2007 Sabol et al.
7,278,820 B2 10/2007 Keller
7,291,407 B2 11/2007 Merrill et al.
7,300,621 B2 11/2007 Merrill
7,311,790 B2 12/2007 Morrison et al.
7,316,539 B2 1/2008 Campbell
7,326,030 B2 2/2008 Albrecht et al.
7,334,330 B2 2/2008 Vance
7,341,428 B2 3/2008 Twerdochlib
7,351,364 B2 4/2008 Morrison et al.
7,371,043 B2 5/2008 Keller
7,387,758 B2 6/2008 Merrill et al.
7,393,183 B2 7/2008 Keller
7,402,347 B2 7/2008 Morrison et al.
2002/0168263 A1 * 11/2002 Bolms ..... 415/173.3
2002/0197465 A1 12/2002 Butner et al.
2003/0035907 A1 2/2003 Campbell et al.
2003/0207155 A1 11/2003 Morrison et al.
2003/0223861 A1 12/2003 Morrison et al.
2004/0001977 A1 1/2004 Subramanian
2004/0043889 A1 3/2004 Campbell
2004/0047726 A1 3/2004 Morrison
2004/0058201 A1 3/2004 Merrill et al.
2004/0219010 A1 11/2004 Merrill et al.
2005/0022921 A1 2/2005 Morrison et al.
2005/0064245 A1 3/2005 Campbell
2005/0076504 A1 4/2005 Morrison et al.
2005/0198967 A1 9/2005 Subramanian
2005/0235493 A1 10/2005 Philip et al.
2005/0238491 A1 10/2005 Morrison et al.
2005/0254942 A1 11/2005 Morrison et al.
2005/0287386 A1 12/2005 Sabol et al.
2006/0019087 A1 1/2006 Mazzola et al.
2006/0056959 A1 3/2006 Sabol et al.
2006/0056960 A1 3/2006 Sabol et al.
2006/0091546 A1 5/2006 Bostanjoglo et al.
2006/0101827 A1 5/2006 Ryan et al.
2006/0120874 A1 6/2006 Burke et al.
2006/0121265 A1 6/2006 Thompson et al.
2006/0121296 A1 6/2006 Morrison et al.
2006/0171809 A1 8/2006 Albrecht et al.
2006/0182971 A1 8/2006 Merrill et al.
2006/0216547 A1 9/2006 Vance
2006/0226290 A1 10/2006 Campbell
2006/0228211 A1 10/2006 Vance et al.
2006/0245984 A1 11/2006 Kulkarni et al.
2006/0257688 A1 11/2006 Schutze et al.
2006/0285973 A1 12/2006 Keller
2006/0286401 A1 12/2006 Kaiser et al.
2006/0292001 A1 12/2006 Keller et al.
2007/0020105 A1 1/2007 Albrecht et al.
2007/0031258 A1 2/2007 Campbell et al.
2007/0047615 A1 3/2007 Twerdochlib
2007/0048144 A1 3/2007 Morrison et al.
2007/0059486 A1 3/2007 Anton et al.
2007/0075455 A1 4/2007 Marini et al.
2007/0077141 A1 4/2007 Keller
2007/0108670 A1 5/2007 Merrill et al.
2007/0128043 A1 6/2007 Morrison et al.
2007/0140835 A1 6/2007 Albrecht et al.
2007/0147996 A1 6/2007 Campbell et al.
2007/0160466 A1 7/2007 Keller
2007/0172676 A1 7/2007 Burns et al.
2007/0189952 A1 8/2007 Easler et al.
2007/0237630 A1 * 10/2007 Schiavo et al. ..... 415/179
2007/0237667 A1 10/2007 Merrill et al.
2007/0258809 A1 11/2007 Mazzola et al.
2007/0275210 A1 11/2007 Heselhaus
2008/0008584 A1 1/2008 Shteyman et al.
2008/0025838 A1 1/2008 Marini et al.
2008/0025842 A1 1/2008 Marini et al.
2008/0025846 A1 1/2008 Vance et al.
2008/0053107 A1 * 3/2008 Weaver et al. ..... 60/800
2008/0087021 A1 4/2008 Radonovich et al.
2008/0101683 A1 5/2008 Zombo et al.
2008/0107521 A1 5/2008 Morrison et al.
2008/0116614 A1 5/2008 Morrison et al.
2008/0131699 A1 6/2008 Vance
2008/0178465 A1 7/2008 Schiavo et al.
2008/0181766 A1 7/2008 Campbell et al.
2008/0199307 A1 8/2008 Keller
2008/0199661 A1 8/2008 Keller et al.
2008/0203236 A1 8/2008 Mazzola et al.
2008/0206542 A1 8/2008 Vance et al.
2008/0207075 A1 8/2008 Merrill et al.
2008/0273967 A1 11/2008 Marini et al.
2008/0274336 A1 11/2008 Merrill et al.
2008/0279678 A1 11/2008 Merrill et al.
2008/0279679 A1 11/2008 Morrison
2008/0280101 A1 11/2008 Morrison et al.
2008/0284059 A1 11/2008 Merrill et al.
2009/0003988 A1 1/2009 Campbell
2009/0010755 A1 1/2009 Keller et al.
2009/0014926 A1 1/2009 Marini
2009/0071160 A1 3/2009 Keller et al.
2009/0081033 A1 3/2009 Schiavo et al.

FOREIGN PATENT DOCUMENTS

EP 1318215 A2 6/2003
EP 1329592 A1 7/2003
EP 1528343 A1 5/2005
EP 1739356 A1 1/2007
EP 1787967 A1 5/2007
EP 1884714 A2 2/2008
EP 1903184 A2 3/2008

| | | | |
|---|---|---|---|
| EP | 2052853 | A2 | 4/2009 |
| WO | 9948837 | A1 | 9/1999 |
| WO | 0052307 | A1 | 9/2000 |
| WO | 0146084 | A1 | 6/2001 |
| WO | 0161250 | A1 | 8/2001 |
| WO | 0218674 | A2 | 3/2002 |
| WO | 02092536 | A1 | 11/2002 |
| WO | 2005043058 | A2 | 5/2005 |
| WO | 2005070613 | A1 | 8/2005 |
| WO | 2006040220 | A1 | 4/2006 |
| WO | 2006040235 | A1 | 4/2006 |
| WO | 2006121570 | A2 | 11/2006 |
| WO | 2007014005 | A1 | 2/2007 |
| WO | 2007025842 | A1 | 3/2007 |
| WO | 2007145607 | A1 | 12/2007 |
| WO | 2008091289 | A2 | 7/2008 |

* cited by examiner

TURBOMACHINE INCLUDING A CERAMIC MATRIX COMPOSITE (CMC) BRIDGE

BACKGROUND OF THE INVENTION

The subject matter disclosed herein relates to the art of turbomachines and, more particularly, to a ceramic matrix composite (CMC) bridge that joins a transition piece with a turbine section of a turbomachine.

In general, gas turbomachine engines combust a fuel/air mixture that releases heat energy to form a high temperature gas stream. The high temperature gas stream is channeled to a turbine section via a hot gas path. The turbine section converts thermal energy from the high temperature gas stream to mechanical energy that rotates a turbine shaft. The turbine section may be employed in a variety of applications, such as for providing power to a pump or an electrical generator.

Many gas turbomachines include an annular combustor within which are formed combustion gases that create the high temperature gas stream. Other turbomachines employ a plurality of combustors arranged in a can-annular array. In such a turbomachine, the hot gas path includes a transition piece that links a group of combustors with a first stage of the turbine section. The combustion gases formed in the group of combustors are delivered to the turbine section through the transition piece.

BRIEF DESCRIPTION OF THE INVENTION

According to one aspect of the invention, a turbomachine includes a turbine section including a turbine inlet. A transition piece includes a transition piece inlet and a transition piece outlet. A ceramic matrix composite (CMC) bridge member links the transition piece outlet and the turbine inlet.

According to another aspect of the invention, a method of delivering combustion gases from a turbomachine combustor to a turbine section of a turbomachine includes producing combustion gases in the turbomachine combustor, directing the combustion gases into a transition piece, guiding the combustion gases along a ceramic matrix composite (CMC) bridge member linking the transition piece and the turbine section, and passing the combustion gases from the CMC bridge member into the turbine section.

According to yet another aspect of the invention, a turbomachine component includes a ceramic matrix composite (CMC) bridge member configured and disposed to link a transition piece and a turbine section of a turbomachine.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

The terms "axial" and "axially" as used in this application refer to directions and orientations extending substantially parallel to a center longitudinal axis of a turbomachine. The terms "radial" and "radially" as used in this application refer to directions and orientations extending substantially orthogonally to the center longitudinal axis of the turbomachine. The terms "upstream" and "downstream" as used in this application refer to directions and orientations relative to an axial flow direction with respect to the center longitudinal axis of the turbomachine.

Figure 1:
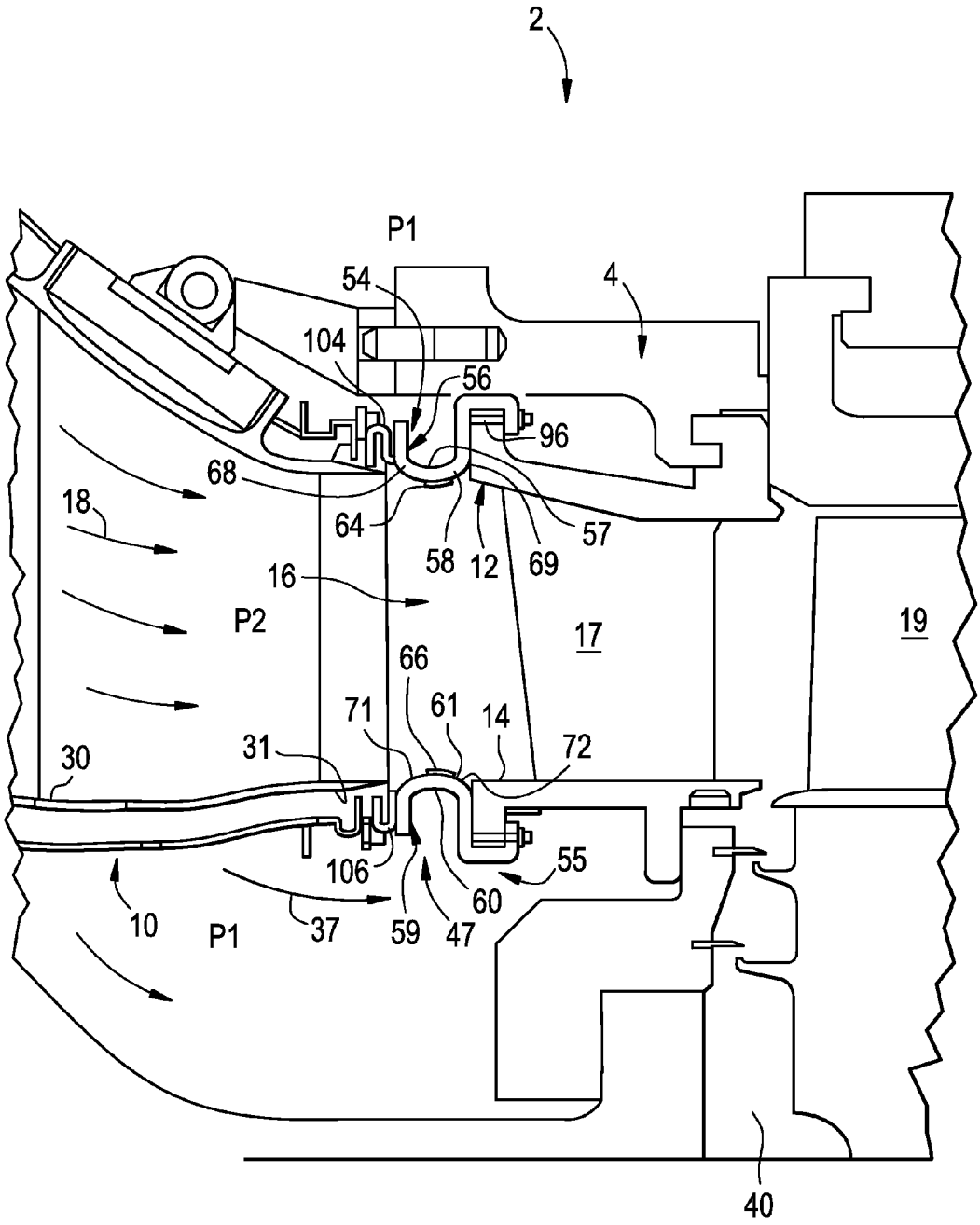
FIG. 1 is a partial cross-sectional view of a turbomachine including a composite matrix material (CMC) bridge including first and second CMC bridge members sealing an interface between a transition piece and a turbine section in accordance with an exemplary embodiment.

With reference to FIG. 1, a turbomachine constructed in accordance with an exemplary embodiment is indicated generally at 2. Turbomachine 2 includes a turbine section 4 that is fluidly linked to a combustor (not shown) through a transition piece 10. Turbine section 4 includes a turbine section inlet 12 defined by an end wall 14. A first stage 16 of turbine section 4 is arranged downstream from turbine section inlet 12. First stage 16 includes a plurality of vanes, one of which is indicated at 17, that guide combustion gases 18 to a plurality of first stage blades, one of which is indicated at 19. Combustion gases 18 flow axially into a transition piece inlet 30, pass through transition piece 10, and exit from a transition piece outlet 31 into turbine section inlet 12. At this point, combustion gases 18 pass over vanes 17 before acting upon blades 19. Blades 19 translate thermal and kinetic energy from combustion gases 18 into mechanical, rotational energy that is employed to rotate a shaft (not shown). In addition to combustion gases 18, compressor discharge air 37 passes from a compressor section (not shown) into a wheel space portion 40 of turbine section 4.

In accordance with an exemplary embodiment, turbomachine 2 includes a ceramic composite material (CMC) bridge 47 that links transition piece outlet 31 with turbine section inlet 12. In accordance with one aspect of the exemplary embodiment, CMC bridge 47 is formed from one or more of silicon carbide-silicon carbide (SiC—SiC) composites, oxide-oxide composites, and silicon nitride composites. Of course it should be understood that various other CMC materials may also be employed. CMC bridge 47 includes a first CMC bridge member 54 arranged at an outer interface between transition piece outlet 31 and turbine section inlet 12, and a second CMC bridge member 55 arranged at an inner interface between transition piece outlet 31 and turbine section inlet 12. First CMC bridge member 54 includes a main body 56 having an outer surface 57 and an inner surface 58. Likewise, second CMC bridge member 55 includes a main body 59 having an outer surface 60 and an inner surface 61.

First CMC bridge member 54 includes a flow guide 64 arranged on inner surface 58. Flow guide 64 directs combustion gases 18 away from end wall 14. Similarly, second CMC bridge member 55 includes a flow guide 66 arranged on inner surface 61. Flow guide 66 directs combustion gases 18 away from end wall 14 and/or disrupts crossflow vortex generation. With this arrangement, end wall 14 is protected from damage that may result from exposure to combustion gases 18. More specifically, combustion gases passing into an inlet portion 68 of CMC bridge member 54 pass over flow guide 64. Flow guide 64 directs combustion gases 18 through an outlet portion 69 of CMC bridge member 54 at trajectory that is angled away from end wall 14. Likewise, combustion gases passing into an inlet portion 71 of CMC bridge member 55 pass over flow guide 66. Flow guide 66 directs combustion gases 18 through an outlet portion 72 of CMC bridge member 55 at trajectory that is angled away from end wall 14.

Figure 2:
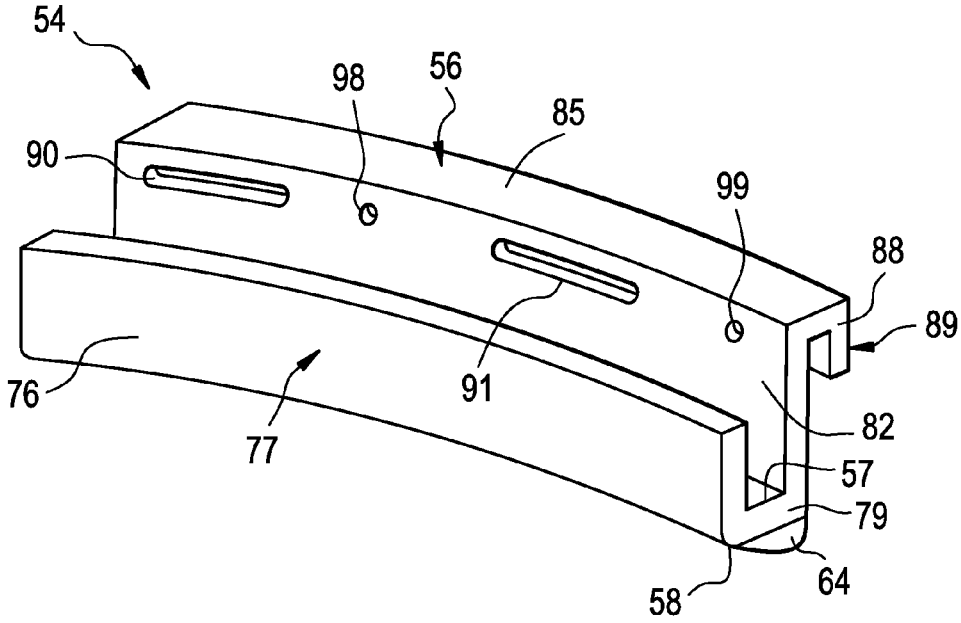
FIG. 2 is a lower right perspective view of the first CMC bridge member of FIG. 1.

As best shown in FIG. 2, bridge member 54 includes a first section 76 that defines a first flange 77. First section 76 leads to a second section 79 that is substantially perpendicular to first section 76. A third section 82 extends from second section 79 and is substantially parallel to first section 76. A fourth section 85, that is substantially parallel to second section 79, extends from third section 82. A fifth section 88, that is substantially parallel to first and third sections 77 and 82, extends from fourth section 85. Third, fourth and fifth sections 82, 85, and 88 combine to define a second flange 89 that joins first CMC bridge member 54 to turbine section 4. In addition, bridge member 54 includes first and second mounting members 90 and 91 that are formed in second flange 89. Mechanical fasteners, one of which is indicated at 96 in FIG. 1, pass through mounting members 90, 91, and turbine section 4 to join first CMC bridge member 54 to turbine section 4. Second flange 89 also includes a plurality of mounting elements 98 and 99 that register with pins (not shown) to locate first CMC bridge member 54 on turbine section 4. Finally, turbomachine 2 is shown to include first and second flexible seals 104 and 106 that are configured to prevent combustion gases from leaking at an interface between transition piece outlet 31 and respective ones of inlet portions 68 and 71 of first and second CMC bridge member 54 and 55.

Figure 3:
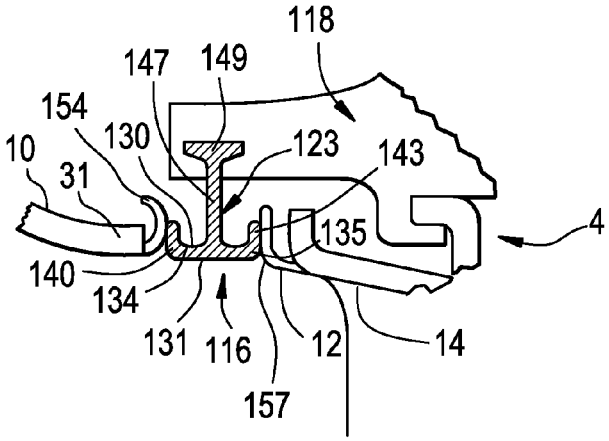
FIG. 3 is a cross-sectional side view of a CMC bridge member in accordance with another aspect of the exemplary embodiment.

Reference will now be made to FIG. 3, wherein like reference numbers represent corresponding parts in the respective views, in describing a CMC bridge member 116 constructed in accordance with another exemplary embodiment. As will become more fully apparent below, CMC bridge member 116 is secured to turbine section 4 through a retaining ring 118 arranged at turbine section inlet 12. CMC bridge member 116 includes a main body 123 including an outer surface 130 and an inner surface 131 that defines an inlet portion 134 and an outlet portion 135. CMC bridge member 116 includes a first flange 140 arranged at inlet portion 134 and a second flange 143 arranged at outlet portion 135. A mounting member 147 extends substantially perpendicularly from outer surface 130. Mounting member 147 includes a dovetail section 149 that cooperates with corresponding structure (not separately labeled) on retaining ring 118 to secure CMC bridge member 116 to turbomachine 2. As further shown in FIG. 3, a first flexible seal 154 extends between inlet portion 134 and transition piece outlet 31 and a second flexible seal 157 extends between outlet portion 135 and turbine section inlet 12 to prevent compressor discharge air from bypassing the combustor and entering turbine inlet 12.

Figure 4:
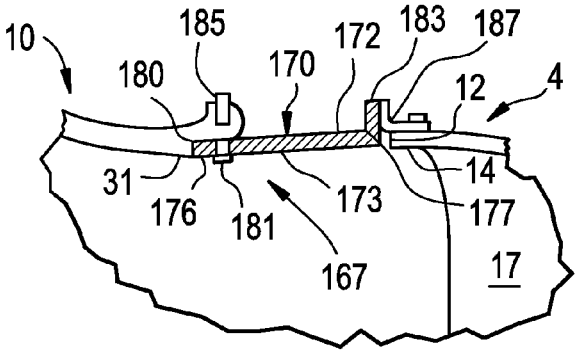
FIG. 4 is a cross-sectional side view of a CMC bridge member in accordance with still another aspect of the exemplary embodiment.

Reference will now be made to FIG. 4, wherein like reference numbers represent corresponding parts in the respective views, in describing a CMC bridge member 167 constructed in accordance with another exemplary embodiment. CMC bridge member 167 includes a main body 170 including an outer surface 172 and an inner surface 173 that defines an inlet portion 176 and an outlet portion 177. CMC bridge member 167 includes a first flange 180 arranged at inlet portion 176. First flange 180 is secured to transition piece outlet 31 through a mechanical fastener 181. CMC bridge 167 also includes a second flange 183 arranged at outlet portion 177. In the exemplary aspect shown, transition piece 10 includes an air channel 185 arranged at transition piece outlet 31. Air channel 185 directs a cooling fluid, for example compressor discharge air, onto first flange 180 to lower temperatures of CMC bridge member 167. As further shown in FIG. 4, a flexible seal 187 extends between outlet portion 177 and turbine section inlet 12 to prevent compressor discharge air from bypassing the combustor and entering turbine inlet 12.

Figure 5:
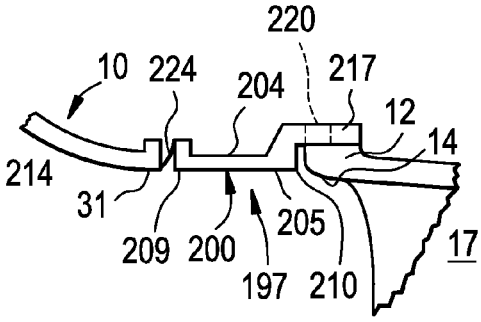
FIG. 5 is a cross-sectional side view of a CMC bridge member in accordance with yet another aspect of the exemplary embodiment.

Reference will now be made to FIG. 5, wherein like reference numbers represent corresponding parts in the respective views, in describing a CMC bridge member 197 constructed in accordance with another exemplary embodiment. CMC bridge member 197 includes a main body 200 including an outer surface 204 and an inner surface 205 that defines an inlet portion 209 and an outlet portion 210. CMC bridge member 197 includes a first flange 214 arranged at inlet portion 209 and a second flange 217 arranged at outlet portion 210. Second flange 217 is secured to turbine section inlet 12 through a mounting member 220. Mounting member 220 includes a sliding interface (not shown) that engages with corresponding structure on turbine section 4. CMC bridge 197 also includes a flexible seal 224 that extends between inlet portion 209 and transition piece outlet 31 to prevent compressor discharge air from bypassing the combustor and entering turbine inlet 12.

At this point it should be understood that the CMC bridge in accordance with exemplary embodiments provides a seal between the transition piece/turbine section interface in order to limit and/or prevent compressor discharge air from entering into the turbine inlet. The transition piece/turbine section interface is typically exposed to high temperatures and thus requires cooling in order to prolong component life. In contrast, the present invention provides a bridge formed from CMC materials that are able to withstand higher temperatures without degrading. By employing the CMC bridge in accordance with the exemplary embodiments the need for cooling airflow at the transition piece/turbine section interface is significantly reduced thereby enhancing turbomachine efficiency. The reduced cooling flow provides additional flow that can be used to extract work from the turbine.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine comprising:

a turbine section including a turbine inlet;

a combustor transition piece including a transition piece inlet and a transition piece outlet;

a ceramic matrix composite (CMC) bridge member linking the transition piece outlet and the turbine inlet, the CMC bridge member including an inlet portion having a first flange operatively connected to the combustor transition piece outlet and an outlet portion having a second flange operatively connected to the turbine inlet; and a seal member provided on one of the transition piece outlet and the turbine inlet, the seal member engaging one of the first and second flanges.

2. The turbomachine according to claim 1, wherein the CMC bridge member includes an outer surface and an inner surface, the inner surface having a flow guide that directs combustion gases into the turbine inlet.

3. The turbomachine according to claim 2, wherein the flow guide is configured and disposed to direct combustion gases away from an end wall portion of the turbine inlet.

4. The turbomachine according to claim 1, wherein the first flange extends about the inlet portion and a second flange extends about the outlet portion.

5. The turbomachine according to claim 4, wherein one of the first and second flanges is fastened to the corresponding one of the combustor and the turbine section.

6. The turbomachine according to claim 5, wherein the seal member comprises a flexible seal member.

7. The turbomachine according to claim 6, further comprising: a retaining ring operatively connected to the turbine section, the at least one bridge member being secured to the retaining ring through the mounting element.

8. The turbomachine according to claim 7, further comprising: a first seal member arranged between the first flange and the combustor and a second seal member arranged between the second flange and the turbine section.

9. The turbomachine according to claim 4, wherein the CMC bridge member includes a mounting element projecting radially outward from the body between the first and second flanges.

10. The turbomachine according to claim 1, wherein the CMC bridge member is formed from one of a silicon carbide-silicon carbide (SiC—SiC) composite, oxide-oxide composite, and silicon nitride composite material.

11. The turbomachine according to claim 1, further comprising: an air channel arranged at the transition piece outlet, the air channel guiding a fluid flow onto the CMC bridge member.

12. A method of delivering combustion gases from a turbomachine combustor to a turbine section of a turbomachine, the method comprising:

producing combustion gases in the turbomachine combustor;

directing the combustion gases into a combustor transition piece;

guiding the combustion gases along a ceramic matrix composite (CMC) bridge member linking the transition piece and the turbine section; and passing the combustion gases from the CMC bridge member into the turbine section, the CMC bridge member including an inlet portion having a first flange operatively connected to a combustor transition piece outlet and an outlet portion having a second flange operatively connected to a turbine inlet; and sealing an interface between the CMC bride member and one of the transition piece and the turbine section to prevent compressor discharge air from entering into a turbine inlet of the turbine section.

13. The method of claim 12, wherein, guiding the combustion gases through the CMC bridge member includes diverting the combustion gases away from an end wall portion of the turbine section.

14. A turbomachine component comprising:

a ceramic matrix composite (CMC) bridge member configured and disposed to link a combustor transition piece and a turbine section of a turbomachine, the CMC bridge member including an inlet portion having a first flange configured and disposed to operatively connect to a combustor transition piece outlet and an outlet portion having a second flange configured and disposed to operatively connect to a turbine inlet; and a seal member provided on one of the transition piece outlet and the turbine inlet, the seal member engaging one of the first and second flanges.

15. The turbomachine component according to claim 14, wherein the CMC bridge member includes an outer surface and an inner surface, the inner surface having a flow guide.

16. The turbomachine component according to claim 14, wherein the first flange extends about the inlet portion and the second flange extends about the outlet portion.

17. The turbomachine component according to claim 16, wherein the CMC bridge member includes a mounting element projection radially outward from the body between the first and second flanges.

18. The turbomachine according to claim 14, wherein the CMC bridge member is formed from one of a silicon carbide-silicon carbide (SiC—SiC) composite, oxide-oxide composite, and silicon nitride composite material.

* * * * *